US011100821B1

(12) United States Patent
Peloquin

(10) Patent No.: US 11,100,821 B1
(45) Date of Patent: Aug. 24, 2021

(54) RETRACTABLE BANNER

(71) Applicant: Bruce C. Peloquin, Milford, MA (US)

(72) Inventor: Bruce C. Peloquin, Milford, MA (US)

(73) Assignee: Fourstar Group Inc., Taipei (TW)

( * ) Notice: Subject to any disclaimer, the term of this patent is extended or adjusted under 35 U.S.C. 154(b) by 0 days.

(21) Appl. No.: 16/540,620

(22) Filed: Aug. 14, 2019

Related U.S. Application Data

(63) Continuation-in-part of application No. 15/435,436, filed on Feb. 17, 2017, now Pat. No. 10,424,230.

(51) Int. Cl.
*G09F 15/00* (2006.01)
*G09F 17/00* (2006.01)

(52) U.S. Cl.
CPC ..... *G09F 15/0062* (2013.01); *G09F 15/0025* (2013.01); *G09F 15/0037* (2013.01); *G09F 17/00* (2013.01); *G09F 2015/0093* (2013.01)

(58) Field of Classification Search
CPC ..... G09F 11/18–29; G09F 2007/1886; Y10T 24/45963
See application file for complete search history.

(56) References Cited

U.S. PATENT DOCUMENTS 3,187,761 A 6/1965 De Maio
3,195,898 A 7/1965 Respini
3,291,094 A * 12/1966 Beebe ..... B63B 21/045 114/218
4,848,437 A 7/1989 Laniado et al.
5,176,774 A 1/1993 Laniado et al.
5,333,880 A 8/1994 Allbright
5,373,655 A * 12/1994 Suzuki ..... G09F 7/18 40/590
5,385,320 A * 1/1995 Ismert ..... F16L 3/10 248/62
5,443,923 A * 8/1995 Laniado ..... B60J 1/2041 156/229
D399,261 S 10/1998 Humphrey
5,884,424 A 3/1999 Smith
6,004,415 A * 12/1999 Ko ..... B29C 53/32 156/150
6,221,458 B1 * 4/2001 Armendariz ..... A41G 1/00 156/391
6,807,999 B1 10/2004 Bowen et al.
(Continued)

FOREIGN PATENT DOCUMENTS

CN 201460683 5/2010

*Primary Examiner* — Cassandra Davis
(74) *Attorney, Agent, or Firm* — Salter & Michaelson

(57) ABSTRACT

A banner unit has a retractable storage position and a display position. The banner unit includes a pair of elongated rigid support posts, and a banner sheet that is comprised of a pair of one and other banner segments that each have opposed one and other side edges. The one side edge of each banner segment is secured to respective elongated rigid support posts. The banner unit also includes an elongated tubular sleeve constructed and arranged to be disposed in parallel with both of the pair of elongated rigid support posts, with the other side edge of each banner segment being secured to the elongated tubular sleeve. Each banner segment is constructed and arranged with a re-coil or retractable characteristic providing a tendency to form into a closed coil configuration when the elongated rigid support posts are brought together.

4 Claims, 13 Drawing Sheets

(56) References Cited

U.S. PATENT DOCUMENTS

| | | | | |
|---|---|---|---|---|
| D554,478 | S | 11/2007 | Robinson | |
| 7,350,325 | B1 * | 4/2008 | Wang | G09F 11/29 40/514 |
| 7,877,914 | B2 | 2/2011 | Taylor et al. | |
| 7,909,310 | B2 | 3/2011 | Weiner | |
| 8,667,718 | B2 * | 3/2014 | Lang | G09F 11/18 40/515 |
| 8,793,911 | B2 | 8/2014 | English | |
| 8,813,401 | B2 | 8/2014 | Diercks | |
| 9,852,663 | B2 * | 12/2017 | Ruddick | G09F 3/08 |
| 10,455,710 | B2 * | 10/2019 | Kim | G09F 9/301 |
| 2008/0005942 | A1 | 1/2008 | Harney | |
| 2010/0024177 | A1 * | 2/2010 | Hayes | F16B 45/00 24/588.1 |
| 2011/0240818 | A1 * | 10/2011 | Gouldson | B65D 75/56 248/340 |
| 2017/0312561 | A1 * | 11/2017 | Polan | A62C 31/02 |

* cited by examiner

RETRACTABLE BANNER

RELATED CASES

This application is a continuation-in-part (CIP) of U.S. Ser. No. 15/435,436 filed on Feb. 17, 2017 and which is incorporated by reference herein in its entirety.

FIELD OF THE INVENTION

The present invention relates in general to a retractable banner. More particularly, the present invention relates to an improved and simplified retractable banner that does not require complex mechanisms for retraction. More particularly, the present invention relates to a retractable banner that is constructed and arranged with a recoil characteristic providing a tendency (memory) that essentially automatically forms the banner material into a closed coil configuration.

BACKGROUND OF THE INVENTION

There are a significant number of patents that exist pertaining to retractable banners. One example is found in U.S. Pat. No. 7,877,914 to Taylor et al. One of the problems associated with existing banners is that they usually require some type of a rather complex mechanism for retracting and extending the banner.

It is an object of the present invention to provide an improved banner apparatus having a closed storage position and an open display position and in which separate segments of the banner material are constructed and arranged with a retractable memory characteristic providing a bias to a closed coil configuration.

Another object of the present invention is to provide a method of displaying a banner by using the banner apparatus of the present invention. This method includes providing alternate set-up and closed steps including a set-up step for maintaining rigid support posts spaced in parallel or alternatively a closed step in which the posts are separated adjacent to each other and spaced by a minimum distance.

Still a further object of the present invention is to provide a banner apparatus having a closed storage position and an open display position and that is comprised of a banner sheet comprised of a pair of banner segments that are interconnected at a middle section and that are each constructed and arranged with a retractable memory characteristic that is adapted to have a memory where the banner segments are in a closed coil configuration.

SUMMARY OF THE INVENTION

To accomplish the foregoing and other objects, features and advantages of the present invention there is provided a banner unit having a retractable storage position and a display position. The banner unit comprises a pair of elongated rigid support posts, and a banner sheet that is comprised of a pair of one and other banner segments that each have opposed one and other side edges, with the one side edge of each banner segment being secured to respective elongated rigid support posts along a length thereof. The banner unit also includes an elongated tubular sleeve constructed and arranged to be disposed in parallel with both of the pair of elongated rigid support posts, the other side edge of each banner segment being secured to the elongated tubular sleeve. Each banner segment is constructed and arranged with a re-coil or retractable characteristic providing a tendency (memory) to form into a closed coil configuration when the elongated rigid support posts are brought together.

In accordance with other aspects of the present invention the banner segments have, on at least one side surface thereof, displayed information; the displayed information includes one of graphics, alpha characters and numeric characters; each of the pair of elongated rigid support posts has a bottom spiked end for ground engagement; each of the pair of elongated rigid support posts has a pair of parallel arranged spiked ends for ground engagement; further including a loop at a top end of each of the pair of elongated rigid support posts; wherein, in the display position, the elongated rigid support posts are maintained in parallel and are separated by a maximum separation distance therebetween; and wherein, in the retractable storage position, the elongated rigid support posts are maintained in parallel and are separated by a minimum separation distance therebetween.

In accordance with another embodiment of the present invention there is provided a banner apparatus having a closed storage position and an open display position. The banner apparatus comprises a pair of elongated rigid support posts, and a banner sheet that is comprised of a pair of one and other banner segments that each have opposed one and other side edges, the one side edge of each banner segment being secured to respective elongated rigid support posts along a length thereof, and a resilient middle piece constructed and arranged to be disposed in parallel with both of the pair of elongated rigid support posts, the other side edge of each banner segment being secured to the resilient middle piece. Each banner segment is constructed and arranged with a retractable memory characteristic providing a tendency to form into a closed coil configuration when the elongated rigid support posts are brought together.

In accordance with other aspects of the present invention the banner segments have, on at least one side surface thereof, displayed information; each of the pair of elongated rigid support posts has a bottom spiked end for ground engagement; further including a loop at a top end of each of the pair of elongated rigid support posts; wherein, in the open display position, the elongated rigid support posts are maintained in parallel and are separated by a maximum separation distance therebetween; and wherein, in the closed storage position, the elongated rigid support posts are maintained in parallel and are separated by a minimum separation distance therebetween.

In accordance with another embodiment of the present invention there is provided a method of displaying a banner by providing a banner unit having a retractable storage position and a display position. The banner unit comprises a pair of elongated rigid support posts, and a banner sheet that is comprised of a pair of one and other banner segments that each have opposed one and other side edges, the one side edge of each banner segment being secured to respective elongated rigid support posts along a length thereof, and an elongated tubular sleeve constructed and arranged to be disposed in parallel with both of the pair of elongated rigid support posts, the other side edge of each banner segment being secured to the elongated tubular sleeve. Each said banner segment is constructed and arranged with a re-coil or retractable characteristic providing a tendency to form into a closed coil configuration when the elongated rigid support posts are brought together. The method includes providing alternate set-up and closed steps comprised of the set-up step including maintaining the elongated rigid support posts in parallel and separated by a maximum separation distance therebetween, while fixedly securing the bottom end of each of the pair of elongated rigid support posts in order to maintain the maximum separation distance therebetween, and alternatively of the closed step including maintaining the elongated rigid support posts in parallel and separated by a minimum separation distance therebetween.

In accordance with other aspects of the present invention the closed step is accomplished without the bottom ends of the elongated rigid support posts being fixedly secured; wherein, in the display position, the bottom ends of the respective elongated rigid support posts are secured by engagement with a ground surface; wherein each of the pair of elongated rigid support posts has a bottom spiked end for ground engagement; and further including providing a loop at a top end of each of the pair of elongated rigid support posts.

In still another embodiment of the present invention there is provided a banner apparatus having a closed storage position and an open display position. The banner apparatus comprises a pair of elongated rigid support posts, and a banner sheet that is comprised of a pair of one and other banner segments that each have opposed one and other side edges, the one side edge of each banner segment being secured to respective elongated rigid support posts, extending about each rigid support post and disposed along a length of each rigid support post, the other side edge of each banner segment being joined together and extending along a length of each other side edge, each said banner segment being constructed and arranged with a retractable memory characteristic providing a tendency to form into a closed coil configuration when the elongated rigid support posts are brought together, in combination with an upright wall, a pair of support hook members and a pair of catch members, said hook members attached to the upright wall at spaced apart location on the upright wall, and the pair of catch members each for releasable engagement with a respective elongated rigid support post at one end thereof and for engagement with a respective hook member at an opposed end thereof, wherein, in the closed storage position, the elongated rigid support posts are maintained in parallel, wherein said catch member extends about the elongated rigid support post, wherein said elongated rigid support posts are each cylindrical in shape, and wherein the one end of each catch member is formed as an integral bifurcated piece that is adapted to snap fit with a respective support post.

In accordance with still other aspects of the present invention the bifurcated piece is formed of separate curved ends that define a gap therebetween; each curved end comprises a circular extension from the catch member having a uniform thickness and a circular engagement surface that mates with the wrapped one side edge of each banner segment; the integral bifurcated piece is comprise of separate curved forks that together form an inner circular engagement surface that is to be snap fitted with the support post; and the separate curved forks extend about greater than one half of the circumference of the support post.

In still a further embodiment of the present invention there is provided a banner apparatus having a closed storage position and an open display position. The banner apparatus comprises a pair of elongated rigid support posts, and a banner sheet that is comprised of a pair of one and other banner segments that each have opposed one and other side edges, the one side edge of each banner segment being secured to respective elongated rigid support posts, extending about each rigid support post and disposed along a length of each rigid support post, the other side edge of each banner segment being joined together and extending along a length of each other side edge. Each of the banner segment is constructed and arranged with a retractable memory characteristic providing a tendency to form into a closed coil configuration when the elongated rigid support posts are brought together. The banner apparatus is in combination with an upright wall, a support assembly that includes pair of hook members and a pair of catch members for supporting the support posts from the upright wall in the open display position, one of said hook members and catch members including a curved attachment end that is for releasable engagement with an elongated rigid support post. Each said elongated rigid support post is cylindrical in shape, wherein, in the closed storage position, the elongated rigid support posts are maintained in parallel, and wherein the one end of each catch member is formed as an integral bifurcated piece that is adapted to snap fit with a respective support post.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which:

FIG. 15 is a perspective view of the embodiment shown in FIGS. 13 and 14 with the addition of a hook that the catch engages with;

DETAILED DESCRIPTION

Reference is now made to the drawings herein that show a preferred embodiment of the banner apparatus of the present invention. The banner apparatus may be considered as having a closed storage position such as illustrated in the perspective view of FIG. 1 or an extended opened display position such as shown in the perspective views of FIGS. 4, 5 and 7. While FIGS. 1-7 illustrate one embodiment of the present invention, an alternate mounting arrangement is illustrated in FIGS. 8-12 and will be described in further detail hereinafter. FIGS. 13-17 illustrate an alternate embodiment of the present invention.

Figure 1:
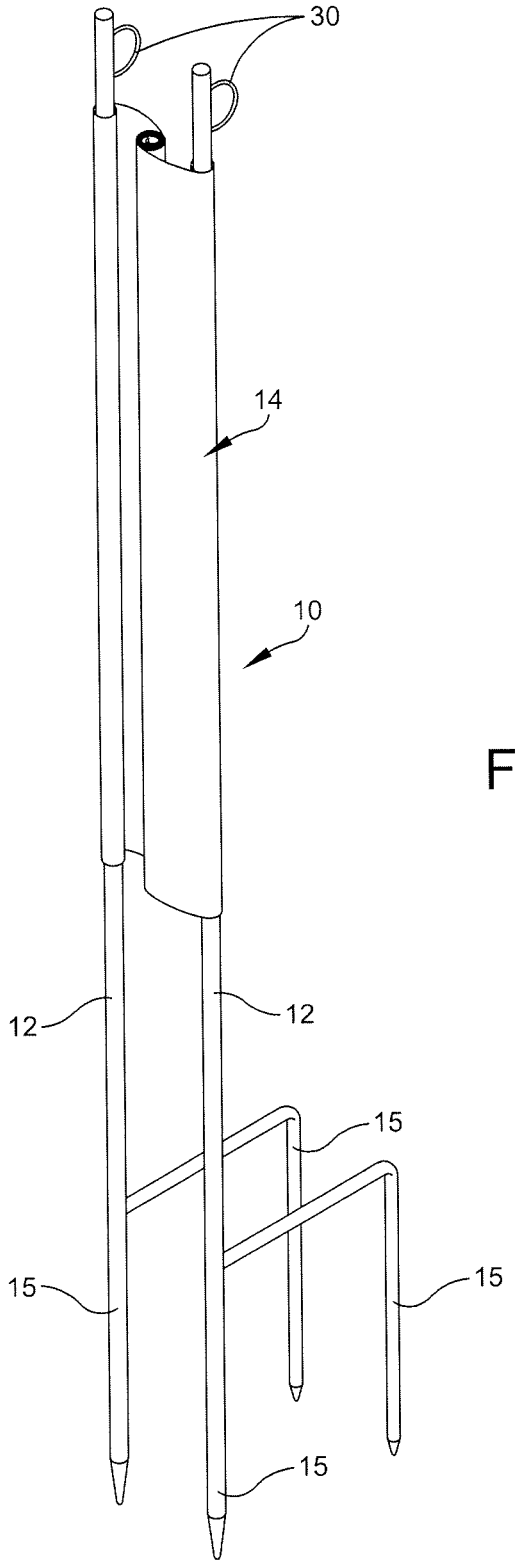
FIG. 1 is a perspective view of the banner apparatus of the present invention in its storage or retracted position.
Figure 2:
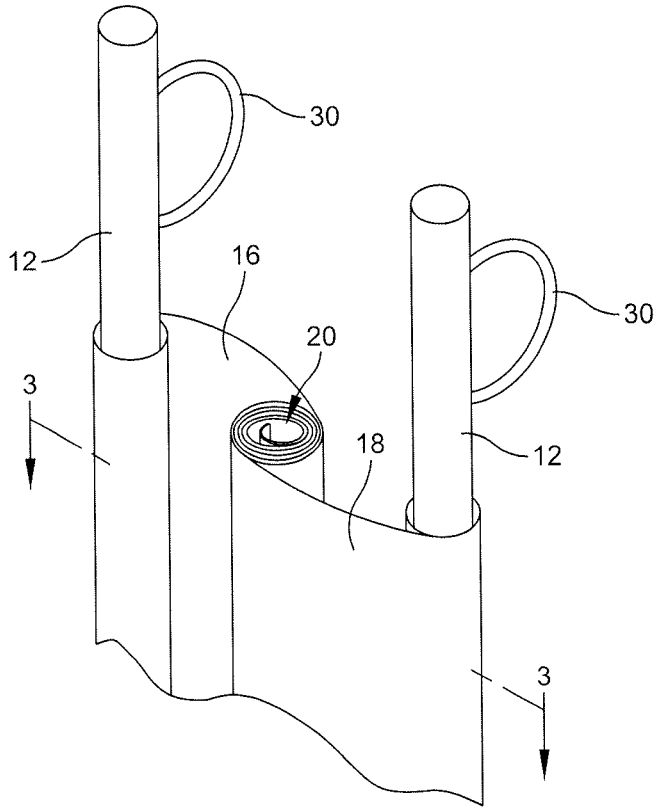
FIG. 2 is a fragmentary perspective view at a top area of the banner apparatus of FIG. 1.

As indicated previously, FIG. 1 is a perspective view illustrating the banner apparatus 10 in its closed position also referred to herein as a storage position. The banner apparatus 10 is comprised of a pair of elongated rigid support posts 12 and a banner sheet 14. The banner sheet 14, such as illustrated in FIG. 4, is considered as comprised of a pair of banner segments 16, 18. Each of the banner segments may be considered as having opposed one and other sides. The one side edge of each banner segment is secured to a respective elongated rigid support post 12. This is illustrated, for example, in FIG. 4 as being secured at the respective sides at 13. Thus, each of the inner segments 16 and 18 are secured to respective posts 12 along a length thereof. This securing may be by the use of an adhesive so that one side of each banner segments is fixed to a corresponding rigid support post 12. An adhesive is illustrated at 17 in FIG. 3 between a side of the banner segment and the corresponding rigid support post 12. In FIG. 4 the arrows A indicate the opening of the banner by stretching the banner material (pulling the posts 12 apart) in the direction of arrows A.

Figure 6:
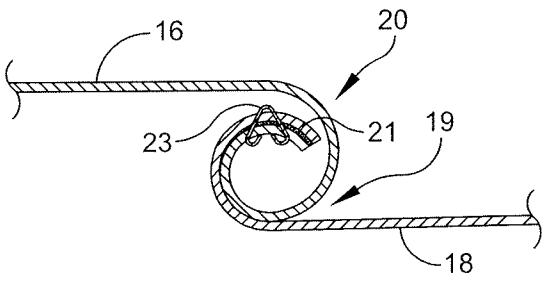
FIG. 6 is a cross-sectional view taken along line 6-6 of FIG. 5 and illustrated particularly at the middle between the banner segments.

As also illustrated in, for example, FIG. 6, in the middle of the banner where the segments 16 and 18 connect, there is provided a resilient middle piece 20. The piece 20 is also referred to herein as an elongated tubular sleeve that is constructed and arranged to be disposed in parallel with both of the pair of elongated rigid support posts 12. The opposite side edges of each banner segment 16, 18 are secured to the resilient middle piece or tubular sleeve 20 as at 19 in FIG. 6.

Figure 4:
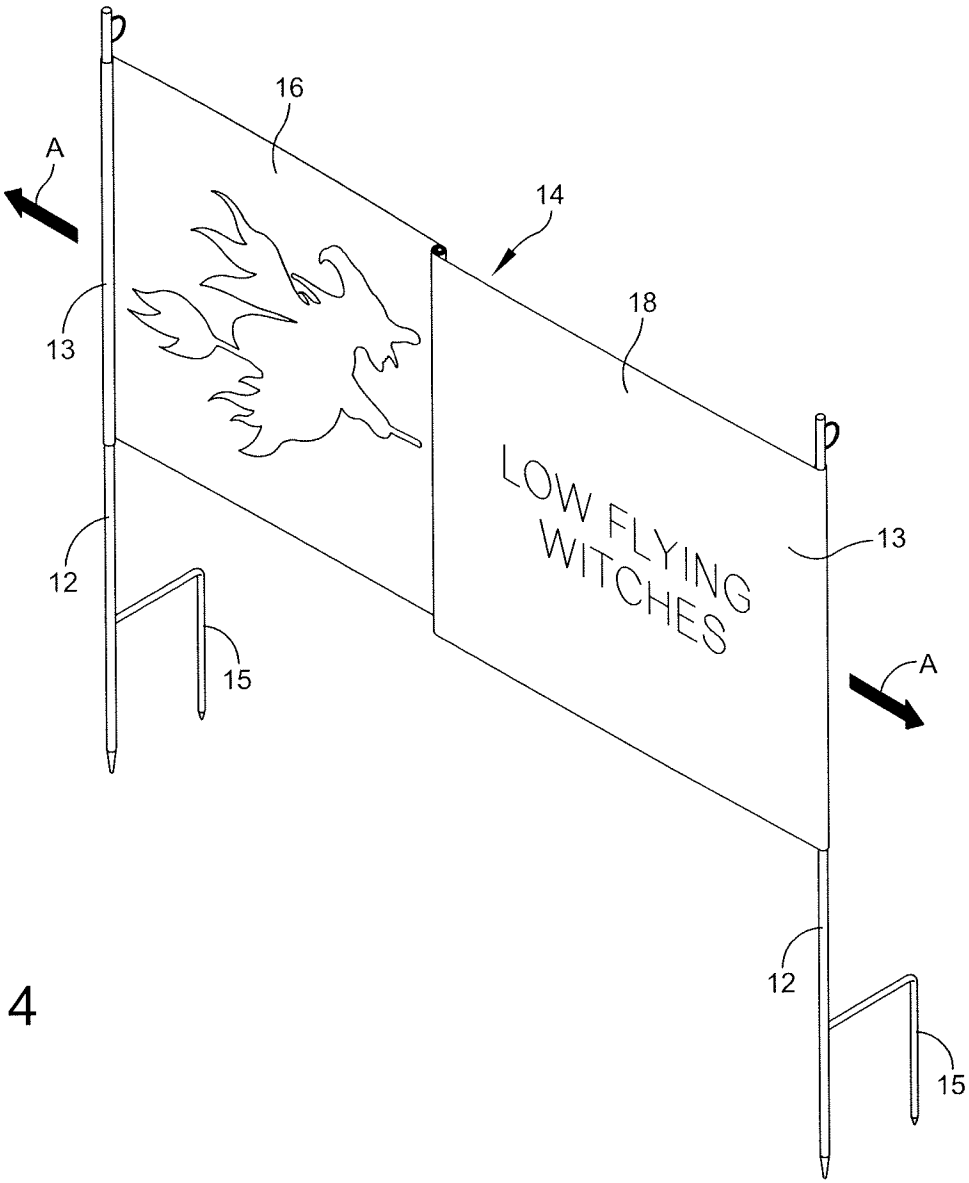
FIG. 4 is a perspective view showing the banner apparatus of the present invention in a fully extended display position.
Figure 5:
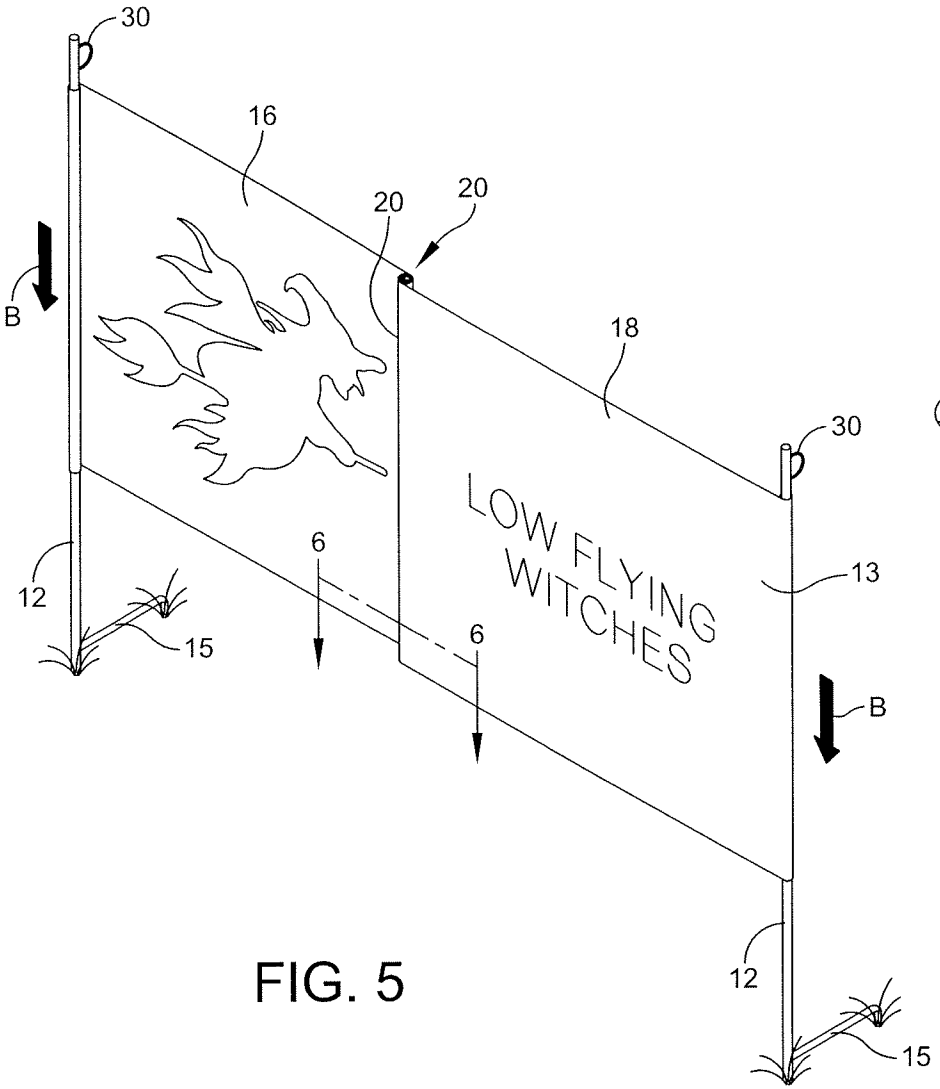
FIG. 5 is a perspective view of the banner apparatus in the display position with the support posts secured into a ground surface.
Figure 7:
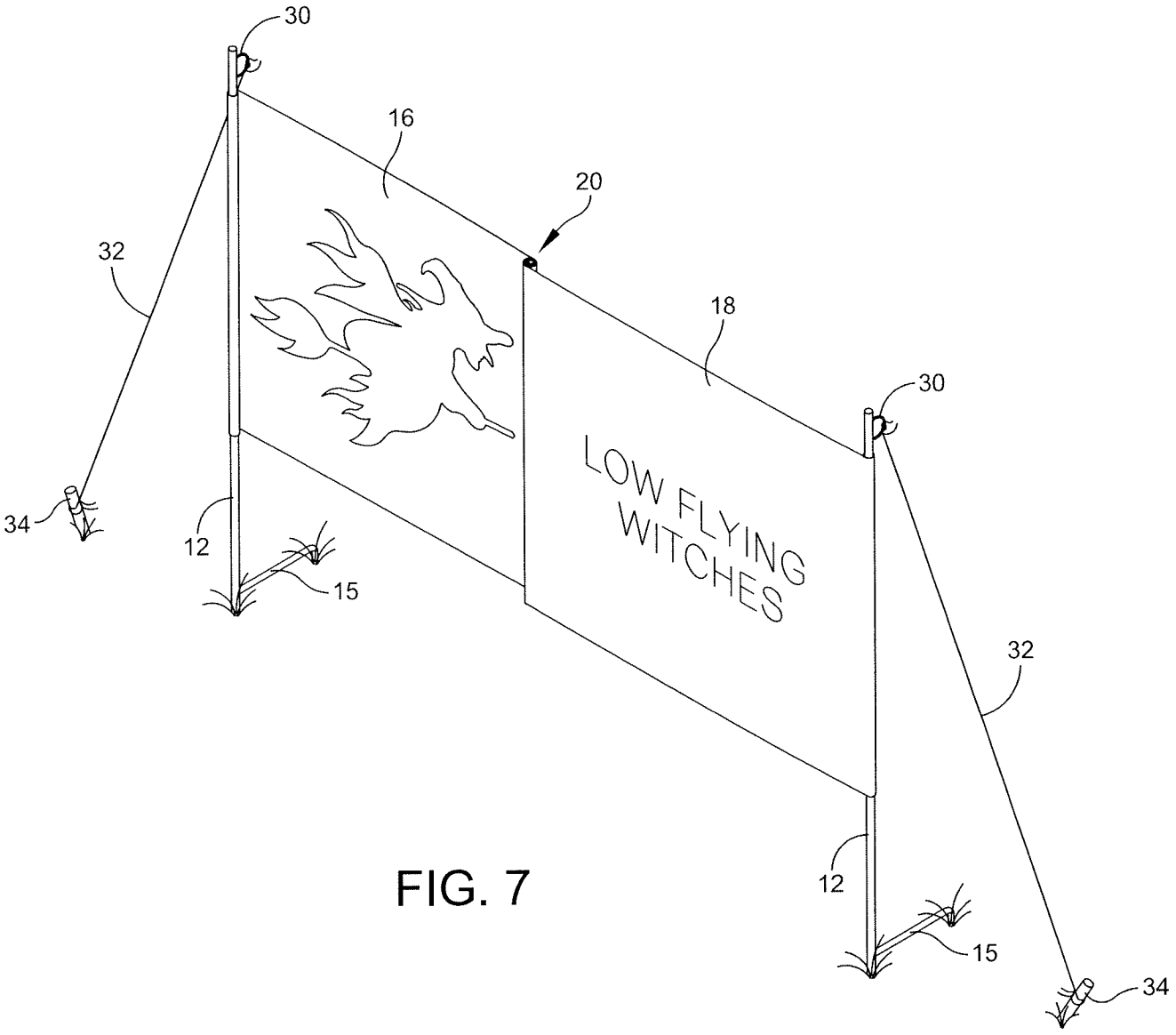
FIG. 7 is a perspective view of the banner apparatus in its display position and further illustrating additional means for securing the banner in a stationery position.

As illustrated in FIGS. 4 and 5, each of the segments 16, 18 have on at least one side surface thereof displayed information. This is illustrated, for example, in FIG. 5 wherein the banner segment 16 has the outline of a "witch." The displayed information on the banner segment 18 is illustrated as "writing". Thus, the displayed information may be graphics, alpha characters, numeric characters or any other displayable information or objects. This information may be provided on one side or opposed sides of each or both banner segments 16, 18. The displayed information may also be coordinated so that an image, or the like, can extend across the respective banner segment 16, 18. In FIG. 5 the arrows B are illustrative of the securing of the banner by means of engaging the stakes 15 into a ground surface. The same is also illustrated in FIG. 7.

The material for the banner is primarily a thermoplastic which will hold its shape. The normal position is a closed position such as shown in FIG. 1 wherein the material itself is constructed with a built in memory. This means that, if the banner material is opened, such as to the position shown in FIG. 4, there is a material memory that automatically forces the material to go back to its stable state; the stable state being a closed coiled position of the banner material. Thus, once the force to separate the banner material is relinquished, the memory of the material provides a biasing force to close the material toward the position of FIG. 1. This closed position is most convenient for transporting the banner. The material for each banner segment, in one embodiment, is made of PET (Polyethylene terephthalate) supported on an aluminum foil material. Then one more OPP (orientated polypropylene) material is coated on the PET side for easy printing purpose. This material is combined by PET and Alum foil in certain percentage. The combined PET/Foil material itself will have the rolling back memory characteristic.

With regard to the elongated rigid support posts, they are preferably provided at a top end thereof with a hook 30. The hook 30, as illustrated in FIG. 7, may be used as an attachment point for an additional securing member. In FIG. 7 this is illustrated by a cord 32 attached at each hook 30 and secured to the ground by means of a stake 34. With further reference to FIG. 1, the bottom end of each of the elongated rigid support posts 12 is provided with at least one spiked end 15. Actually, in the embodiment of FIG. 1, a pair of parallel spike ends 15 is provided to assist in engaging each of the elongated rigid support posts into a ground surface such as illustrated in FIG. 5. FIG. 5 shows the banner apparatus secured into the ground surface.

Figure 3:
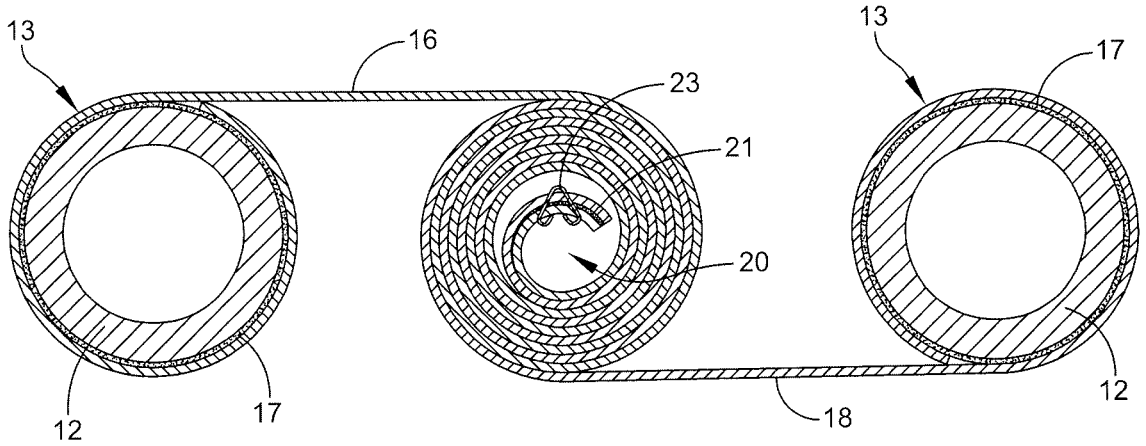
FIG. 3 is a cross-sectional view taken along line 3-3 of FIG. 2 with the banner in a basically closed or retracted position.

The cross-sectional view of FIG. 3 illustrates a more closed position of the banner segments 16, 18. At the middle piece 20 it is formed as a tubular sleeve where an adhesive 21 can also be used to secure the joined ends of the respective banner segments 16, 18. Refer to FIGS. 3 and 6. Also show in FIG. 3 is a staple 23 used to secure the respective ends of the segments that essentially form the tubular sleeve 20. In this regard refer also to the cross-sectional view of FIG. 6 wherein the banner segments are in a display or open position thus, leaving the tubular sleeve 20 as the means by which the respective banner segments 16, 18 are joined. This joining provides essentially a single piece banner. In the display position the diameter of the tubular sleeve is small in comparison to the width of each banner segment 16, 18.

Figure 8:
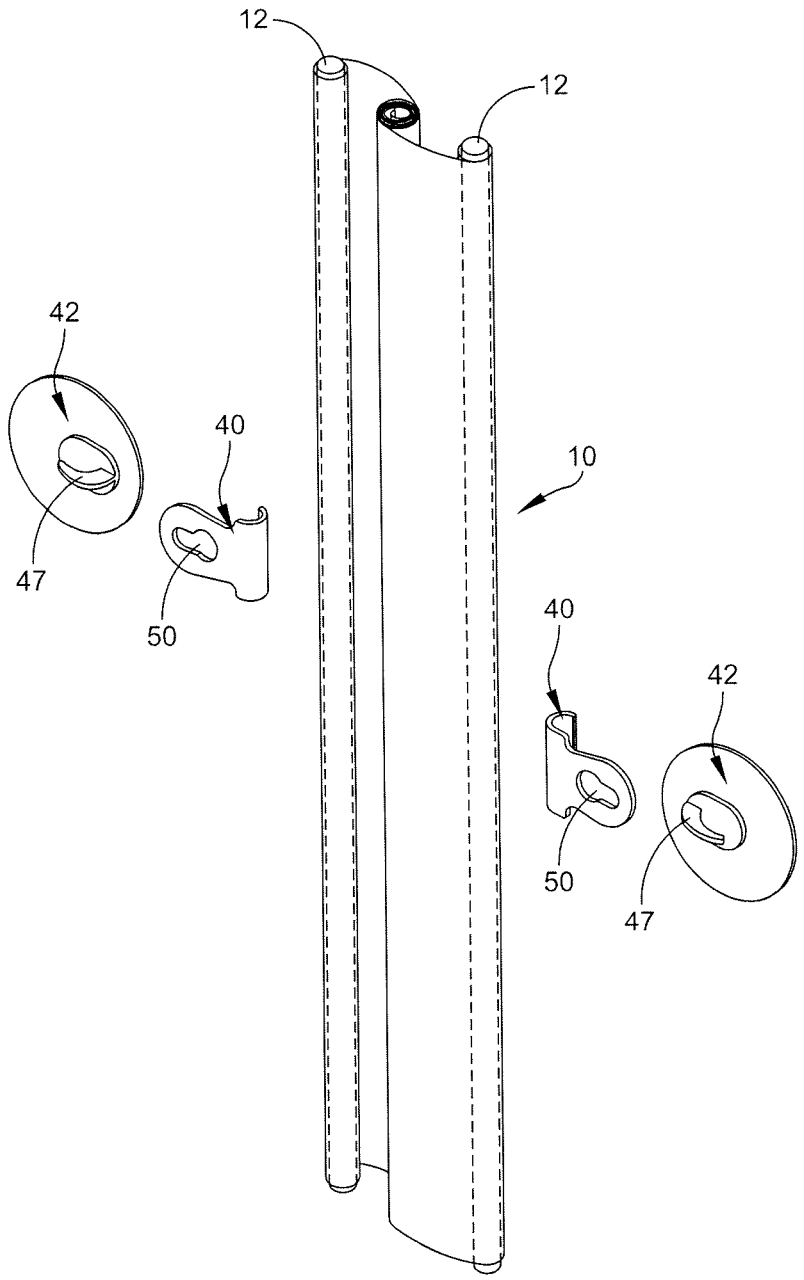
FIG. 8 is a perspective view of the banner apparatus of the present invention in a storage or retracted position showing an alternate arrangement for securing the banner.
Figure 9:
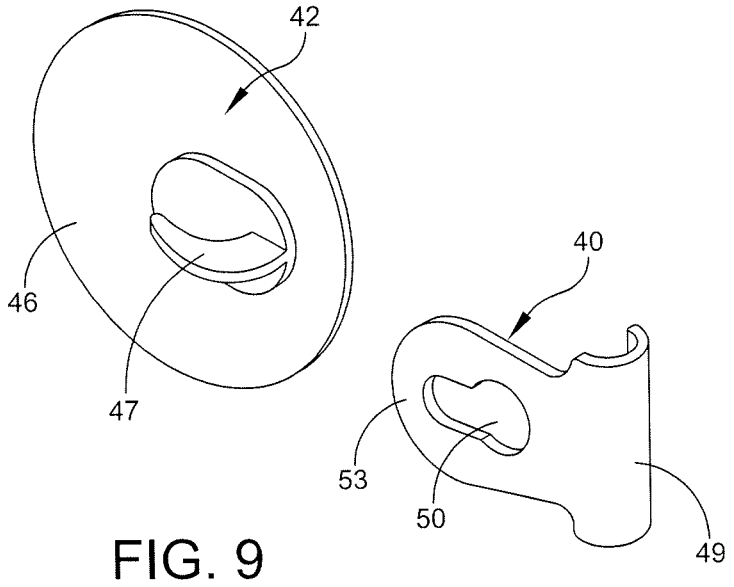
FIG. 9 is a perspective view of the hook and catch mechanism in an unhooked position.
Figure 10:
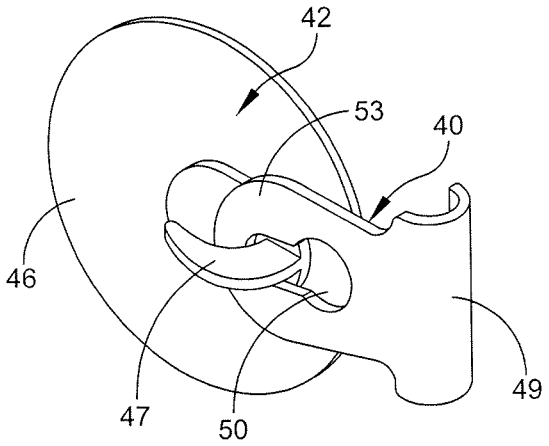
FIG. 10 is a perspective view of the hook and catch mechanism in a secured position.
Figure 11:
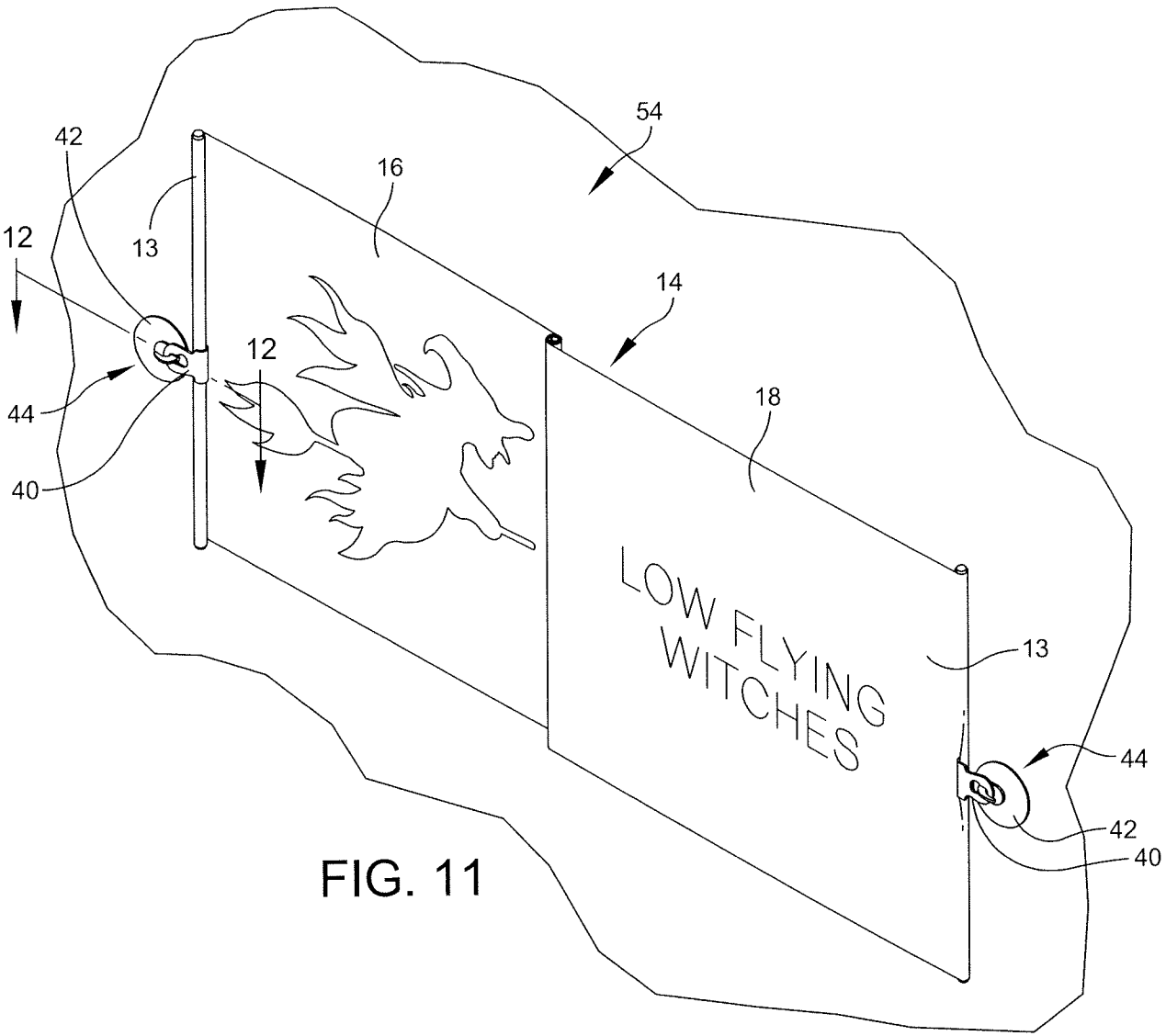
FIG. 11 is a perspective view of the entire banner apparatus in this alternate embodiment showing the use of the hook and catch mechanism.
Figure 12:
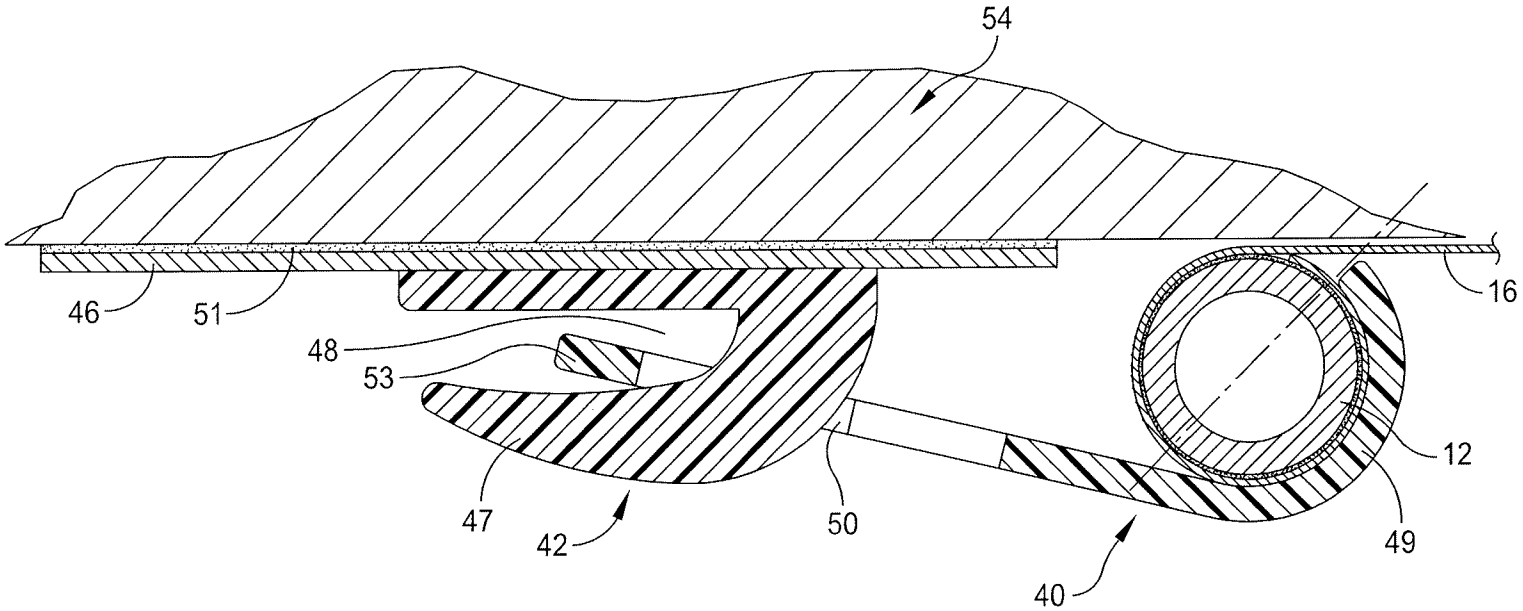
FIG. 12 is a cross-sectional view taken along line 12-12 of FIG. 11.
Figure 13:
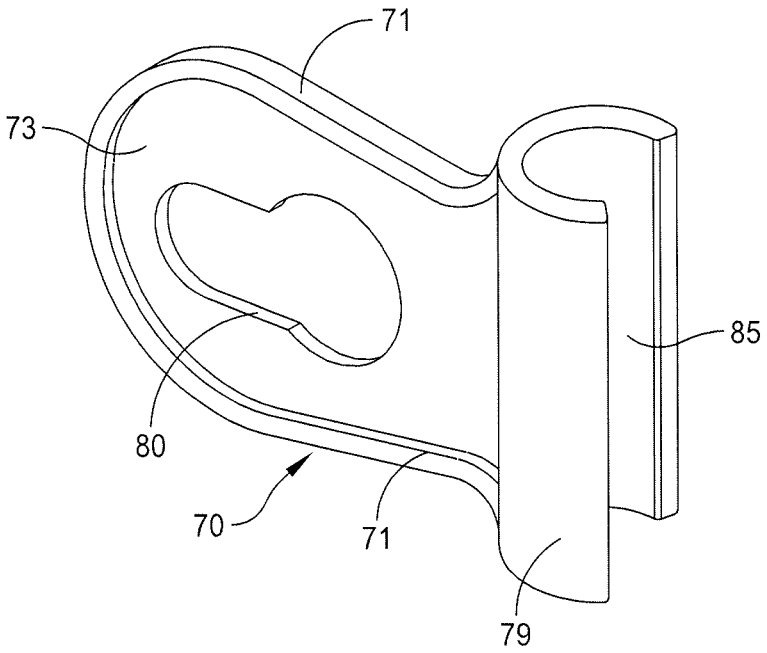
FIG. 13 is a perspective view of an alternative catch construction.

Reference is now made to FIGS. 8-12 for an alternate embodiment of the present invention that enables attachment of the banner apparatus or banner unit 10 to an alternate support surface such as the surface 54 illustrated in FIG. 12. The banner apparatus 10 is comprised of a pair of elongated rigid support posts 12 and a banner sheet 14. The banner sheet 14, such as illustrated in FIGS. 8 and 11, is considered as comprised of a pair of banner segments 16, 18. Each of the banner segments may be considered as having opposed one and other sides. The one side edge of each banner segment is secured to a respective elongated rigid support post 12. This is illustrated, for example, in FIG. 11 as being secured at the respective sides at 13. Thus, each of the inner segments 16 and 18 are secured to respective posts 12 along a length thereof. This securing may be by the use of an adhesive so that one side of each banner segment is fixed to a corresponding rigid support post 12.

In the first embodiment described, these rigid support posts 12 have a bottom end that enables these posts to be inserted into a ground surface. In the alternate embodiment of FIGS. 8-12, the banner is meant for support from a sidewall of some type which may be, for example, a garage door or large window. Thus, as noted in FIGS. 8 and 11, each of the rigid support posts are of the same length as that of the banner apparatus. The support posts may be moved from the position of FIG. 8 to the position of FIG. 11 in a manner as previously described and each of the respective support posts 12 are then fixed in position by means of the catch member 40 and hook member 42. These items provide the illustrated hook and catch mechanism 44. As indicated previously, this mechanism is shown in an unlatched position in FIG. 9 and in a latch position in FIG. 10.

The catch member 40 is comprised of a curved shape end catch 49 and a section that is orthogonal to the catch 49 that includes the hole 50. The catch 49 is adapted to snap interlock about the respective support posts 12 such as illustrated in the cross sectional view of FIG. 12.

The hook member 42 is comprised of a base piece 46 and a hook 47 that defines an open recess 48. FIGS. 11 and 12 illustrate the base 46 secured in position to the wall 54. The base 46 may be secured by means of an adhesive shown at 51 in FIG. 12. Alternatively, the base 46 may be in the form of a suction cup depending upon the particular application. In still another embodiment the base 46 may be secured in any manner to the upright surface 54, such as by being screwed to the surface 54. Also, mechanisms other than the catch and hook arrangement may be used so that the banner can be substantially permanently attached to the upright wall surface. This may be by screwing the member 40 directly to the upright wall structure. Once the hook member 42 is in position with the respective hook members being disposed a distance apart, such as illustrated in FIG. 11, then the banner 14 can be stretched to its extended position as illustrated in FIG. 11. The extending end wall 53 of the catch member 40 then engages with the hook 47. The hook 47, as illustrated in FIG. 10, engages the wall 53 at the hole 50 thus securing the opposed left and right ends of the banner illustrated in FIG. 11.

Figure 15:
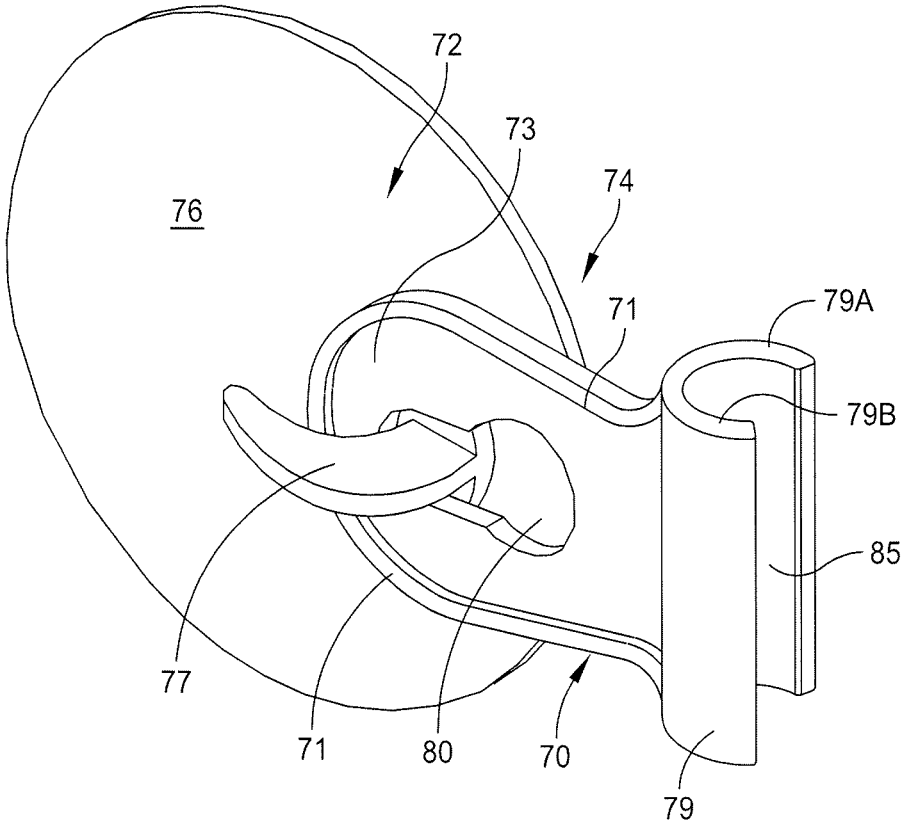
Figure 16:
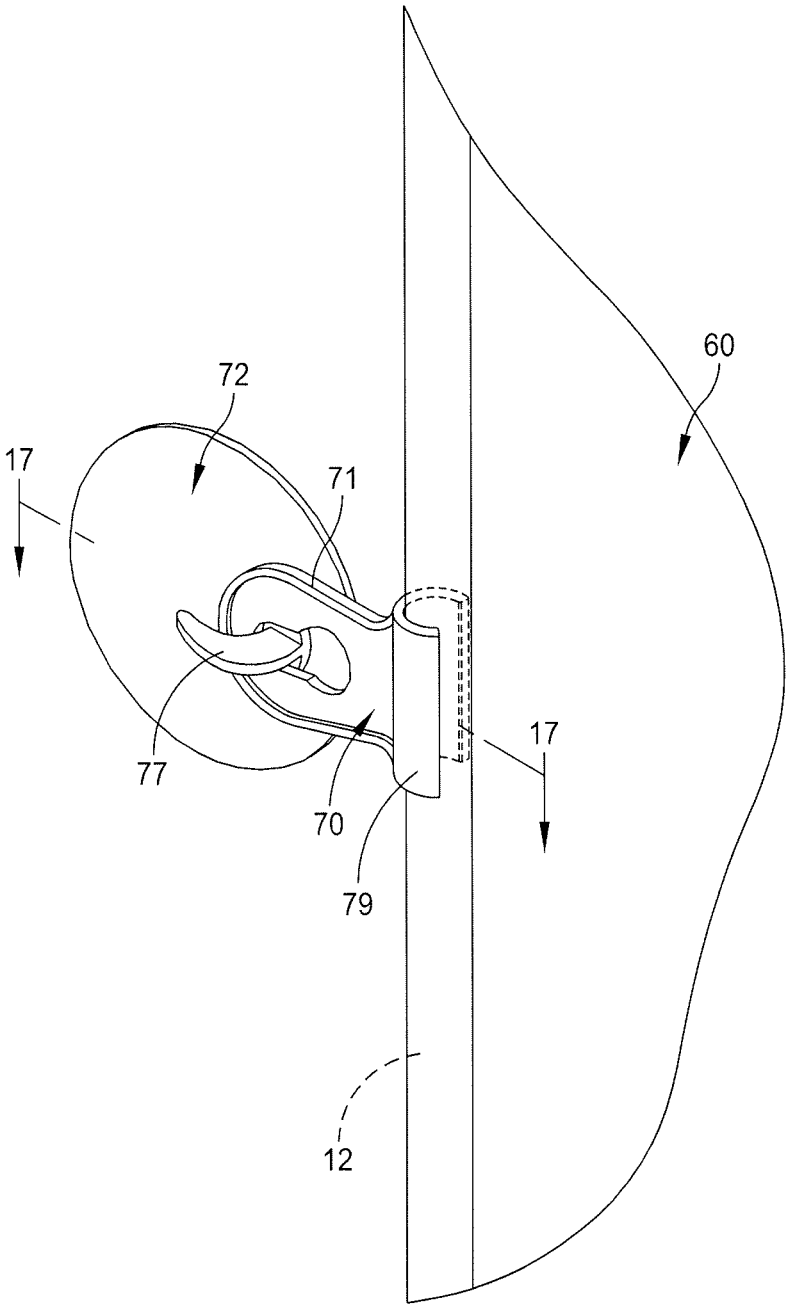
FIG. 16 is a perspective view showing the catch and hook as associated with the banner; particularly the post side of the banner.
Figure 17:
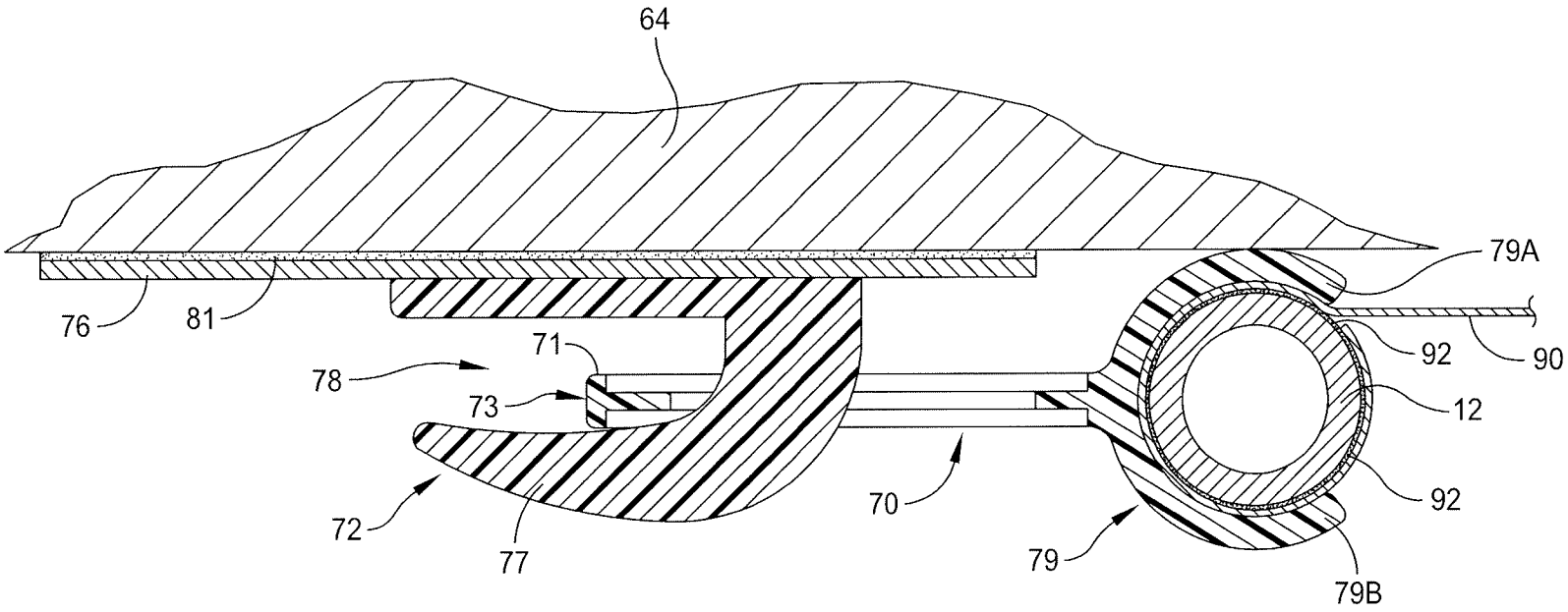
FIG. 17 is a cross-sectional view taken along line 17-17 of FIG. 16.

Reference is now made to FIGS. 13-17 for an alternate embodiment of the present invention that enables attachment of the banner apparatus or banner unit 60 to an alternate support surface such as the surface 64 illustrated in FIG. 17. The banner apparatus 60 is comprised of a pair of elongated rigid support posts and a banner sheet, as previously described. The banner sheet, such as illustrated in FIGS. 8 and 11, is considered as comprised of a pair of banner segments. Each of the banner segments may be considered as having opposed one and other sides. The one side edge of each banner segment is secured to a respective elongated rigid support post 12. This is illustrated, for example, in FIG. 11 as being secured at the respective sides at 13. Thus, each of the inner segments are secured to respective posts 12 along a length thereof. This securing may be by the use of an adhesive so that one side of each banner segment is fixed to a corresponding rigid support post 12.

In the first embodiment described, these rigid support posts have a bottom end that enables these posts to be inserted into a ground surface. In the alternate embodiment of FIGS. 8-12, the banner is meant for support from a sidewall of some type which may be, for example, a garage door or large window. Similarly, in the embodiment shown in FIGS. 13-17 the banner is meant for support from a sidewall of some type which may be, for example, a garage door or large window. Thus, as noted in FIGS. 8 and 11, each of the rigid support posts are of the same length as that of the banner apparatus. The support posts may be moved from the position of FIG. 8 to the position of FIG. 11 in a manner as previously described and each of the respective support posts are then fixed in position by means of the catch member 70 and hook member 72. These items provide the illustrated hook and catch mechanism 74. As indicated previously, this mechanism is shown in an unlatched position in FIG. 9 and in a latch position in FIG. 10.

The catch member 70 is comprised of a bifurcated end shape 79 and a section that is orthogonal to the catch 49 that includes the hole 50. The bifurcated catch end 79 is adapted to snap interlock about the respective support posts 12 such as illustrated in the cross sectional view of FIG. 17. The catch member 70 also is provided with a peripheral enlarged rim 71 that provides some reinforcement at the edge area. The hook member 72 is comprised of a base piece 76 and a hook 77 that defines an open recess 78. In FIGS. 15-17 the hook 77 is integrally formed with the base piece 76. FIG. 17 illustrate the base piece 76 secured in position to the wall 64. The base piece 76 may be secured by means of an adhesive shown at 81 in FIG. 17. Alternatively, the base 76 may be in the form of a suction cup depending upon the particular application. In still another embodiment the base 76 may be secured in any manner to the upright surface 64, such as by being screwed to the surface of the wall 64.

Also, mechanisms other than the catch and hook arrangement may be used so that the banner can be substantially permanently attached to the upright wall surface. This may be by screwing the member 70 directly to the upright wall structure. Once the hook member 72 is in position with the respective hook members being disposed a distance apart, such as illustrated in FIG. 11, then the banner can be stretched to its extended position as illustrated in FIG. 11. The extending end wall 73 of the catch member 70 then engages with the hook 77, as depicted in FIGS. 15-17. The hook 77, as illustrated in FIG. 15, engages the wall 73 at the hole 80 thus securing the opposed left and right ends of the banner as illustrated in FIG. 11. The hole 80 is preferably keyhole shape with a constant diameter larger portion and a smaller slot portion.

Figure 14:
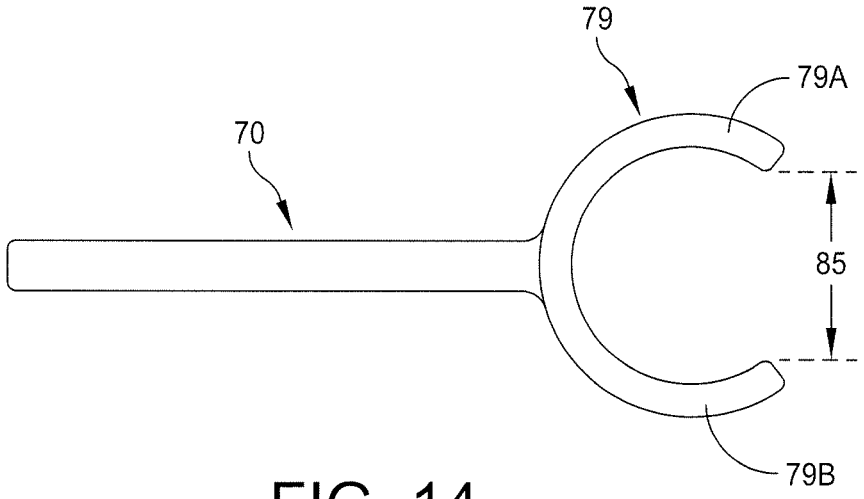
FIG. 14 is a plan view of the catch of FIG. 13.

In the embodiment shown in FIGS. 13-17 the bifurcated end 79, as particularly illustrated in FIG. 14 is formed of a pair of like forks 79A, 79B that define therebetween a gap 85 that is selected so as to provide a snap fit with the banner, particularly with the respective posts, as illustrated in the cross-sectional view of FIG. 17. In this regard the gap 85 is preferably slightly smaller than the diameter of the post 12. The forks 79A, 79B are constructed to provide some flexibility to enable the forks to spread so as to be accommodated about the post as shown in FIG. 17. FIG. 17 shows the forks about the post with the banner segment 90 secured to the post by an adhesive as at 92.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A banner apparatus having a closed storage position and an open display position, said banner apparatus comprising a pair of elongated rigid support posts, and a banner sheet that is comprised of a pair of one and other banner segments that each have opposed one and other side edges, the one side edge of each banner segment being secured to respective elongated rigid support posts, extending about each rigid support post and disposed along a length of each rigid support post, the other side edge of each banner segment being joined together and extending along a length of each other side edge, each said banner segment being constructed and arranged with a retractable memory characteristic providing a tendency to form into a closed coil configuration when the elongated rigid support posts are brought together, in combination with an upright wall, a pair of support hook members and a pair of catch members, said hook members attached to the upright wall at spaced apart location on the upright wall, and the pair of catch members each for releasable engagement with a respective elongated rigid support post at one end thereof and for engagement with a respective hook member at an opposed end thereof, wherein, in the closed storage position, the elongated rigid support posts are maintained in parallel, wherein said catch member extends about the elongated rigid support post, wherein said elongated rigid support posts are each cylindrical in shape, and wherein the one end of each catch member is formed as a bifurcated piece that is adapted to engage with a respective support post, wherein the bifurcated piece is comprised of separate curved forks that together form an inner circular engagement surface that is to be fitted with the support post, and wherein the separate curved forks extend about greater than one half of the circumference of the support post, and the catch member at the hole is planar and includes a peripheral raised edge.

2. The banner apparatus of claim 1 wherein each curved end comprises a circular extension from the catch member having a uniform thickness and a circular engagement surface that mates with the wrapped one side edge of each banner segment.

3. A banner apparatus having a closed storage position and an open display position, said banner apparatus comprising a pair of elongated rigid support posts, and a banner sheet that is comprised of a pair of one and other banner segments that each have opposed one and other side edges, the one side edge of each banner segment being secured to respective elongated rigid support posts, extending about each rigid support post and disposed along a length of each rigid support post, the other side edge of each banner segment being joined together and extending along a length of each other side edge, each said banner segment being constructed and arranged with a retractable memory characteristic providing a tendency to form into a closed coil configuration when the elongated rigid support posts are brought together, in combination with an upright wall, a support assembly that includes pair of hook members and a pair of catch members for supporting the support posts from the upright wall in the open display position, one of said hook members and catch members including a curved attachment end that is for releasable engagement with an elongated rigid support post, each said elongated rigid support post being cylindrical in shape, wherein, in the closed storage position, the elongated rigid support posts are maintained in parallel, and wherein the one end of each catch member is formed as a bifurcated piece that is adapted to snap fit with a respective support post, wherein the bifurcated piece is comprised of separate curved forks that together form an inner circular engagement surface that is to be snap fitted with the support post, and wherein the separate curved forks extend about greater than one half of the circumference of the support post, and the catch member has a hole that engages with the hook member, wherein the hook member includes a suction cup that is integrally formed therewith.

4. The banner apparatus of claim 3 wherein each curved end comprises a circular extension from the catch member having a uniform thickness and a circular engagement surface that mates with the wrapped one side edge of each banner segment.

* * * * *